United States Patent [19]

Jahn et al.

[11] 4,041,668

[45] Aug. 16, 1977

[54] CLIP STRUCTURE FOR A CONCEALED GRID STRUCTURE OF A SUSPENDED CEILING

[75] Inventors: Martin D. Jahn, Riverside; Glenn F. Balfanz, Jr., Western Springs, both of Ill.

[73] Assignee: Chicago Metallic Corporation, Chicago, Ill.

[21] Appl. No.: 637,724

[22] Filed: Dec. 4, 1975

[51] Int. Cl.[2] ..... E04B 5/52

[52] U.S. Cl. ..... 52/489; 52/484

[58] Field of Search ..... 52/489, 484, 487, 760

[56] References Cited

U.S. PATENT DOCUMENTS

| | | | |
|---|---|---|---|
| 1,714,682 | 5/1929 | Loacks | 52/760 |
| 2,822,584 | 2/1958 | Urbain | 52/484 |
| 2,866,233 | 12/1958 | Lydard | 52/760 |
| 3,139,162 | 6/1964 | Spangenberg | 52/489 |
| 3,233,297 | 2/1966 | Havener | 52/760 |
| 3,295,284 | 1/1967 | Tschlesche | 52/484 |
| 3,307,315 | 3/1967 | Schneller | 52/760 |
| 3,390,856 | 7/1958 | Van Baren | 52/489 |
| 3,447,823 | 6/1969 | Gregoire | 52/760 |
| 3,784,144 | 1/1974 | Ollinger | 52/484 |
| 3,809,358 | 5/1974 | Hazeley | 52/484 |
| 3,828,508 | 8/1974 | Moeller | 52/489 |

FOREIGN PATENT DOCUMENTS

| | | | |
|---|---|---|---|
| 109,907 | 7/1968 | Denmark | 52/484 |
| 1,252,769 | 12/1960 | France | 52/484 |
| 1,263,407 | 5/1961 | France | 52/484 |
| 897,747 | 5/1962 | United Kingdom | 52/484 |
| 677,160 | 8/1952 | United Kingdom | 52/489 |

*Primary Examiner*—Price C. Faw, Jr.
*Assistant Examiner*—Henry Raduazo
*Attorney, Agent, or Firm*—Hill, Gross, Simpson, Van Santen, Steadman, Chiara & Simpson

[57] ABSTRACT

A clip structure for the assembly of concealed grid runners of a suspended ceiling structure, in which the clip is constructed for engagement with a supporting structure such as a flange portion of a suitably supported mounting member, for example a Z-shaped runner, or from the flange of an existing grid system which is to form the support for a new ceiling structure therebelow, in which the clip comprises a mounting structure therefor and a runner-supporting structure integrally connected therewith, the mounting structure being adapted to be engaged with the supporting member which is to carry the same and having the supporting structure extending downwardly from the mounting structure. The latter is provided with a T-shaped notch therein which extends to the bottom edge portion of the mounting structure with such T-shaped notch being proportioned to receive the upper edge bead structure of a runner and interlock the clip thereto. The clip thus is slidable along the supporting member carrying the same with the runner to be supported by the mounting structure likewise being slidable relative to the clip whereby no preset dimensions are involved with respect to either locating the clip on the supporting member or the runner with respect to the clip.

4 Claims, 10 Drawing Figures

Fig. 1
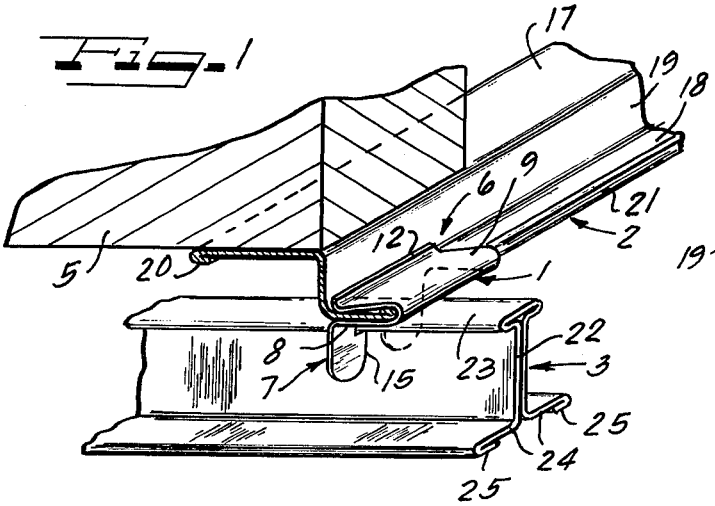
Fig. 2
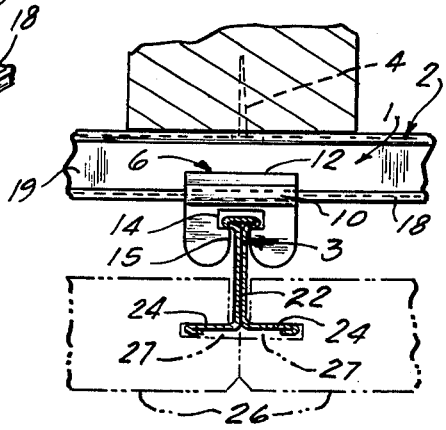
Fig. 3
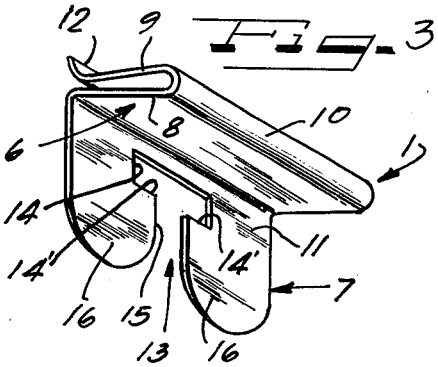
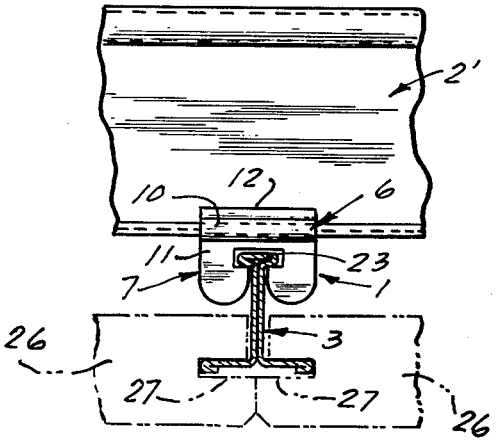
Fig. 5
Fig. 4
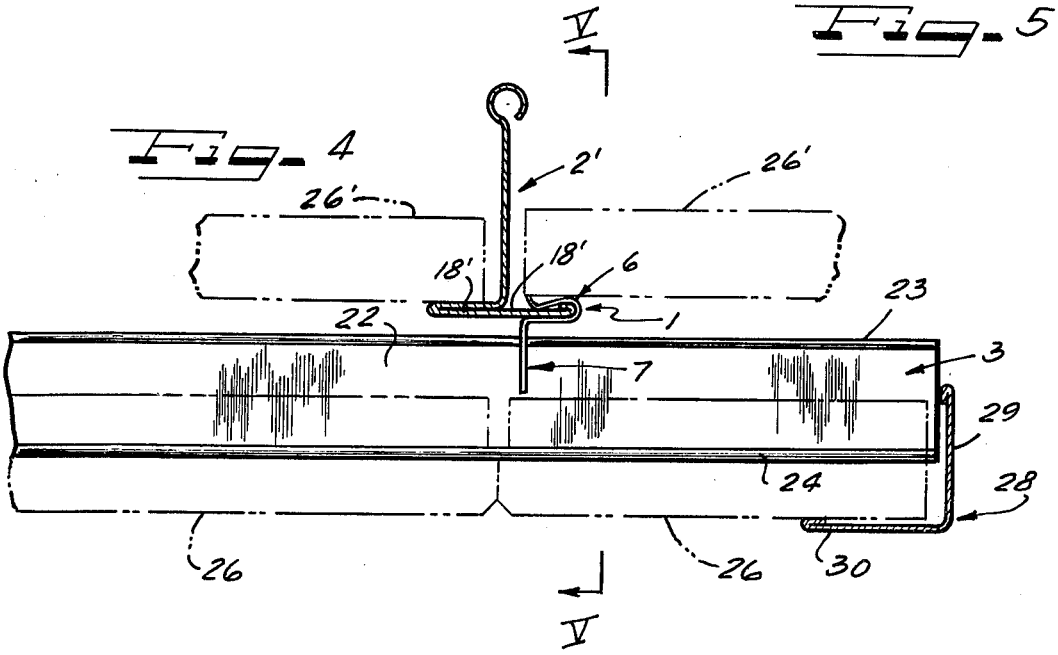

CLIP STRUCTURE FOR A CONCEALED GRID STRUCTURE OF A SUSPENDED CEILING

BACKGROUND OF THE INVENTION

With the advent of suspended ceiling structures, in which a rectangular grid structure was suitably supported and adapted to carry rectangular ceiling panel tiles or the like, the supporting grid structure initially consisted of a plurality of spaced parallel main runners which were connected at spaced intervals by transversely extending cross-runners to form a rectangular grid structure in which the ceiling panel tiles were supported, either with the grid structure being completely concealed or portions thereof being exposed to view.

In such suspended ceiling structures, the main runners were required to be set at comparatively exact spacing distances and the cross runners secured thereto in comparatively accurately spaced intervals. In such constructions, the ends of the cross runners usually intersected and were interlocked with the main runners to provide a grid structure having specific set or fixed spacing between the respective main and cross runners.

In recent years do-it-yourself installations have become more and more popular, wherein the unskilled homeowner or the like purchases the ceiling structure in kit form and performs the installation himself. Difficulties often arose as a result of the requirement of accurate spacing between parallel runners, necessitating accurate layout and mounting of the respective runners, a relatively difficult operation for persons unskilled in the art. To avoid these difficulties, efforts have been made to provide structures that did not require the accurate layout and mounting of previous designs.

BRIEF SUMMARY OF THE INVENTION

The present invention is directed to a suspended ceiling installation which does not require any accurate mounting of the panel-supporting runners, at the same time enabling the runner installation to be made in a very simple manner, requiring extremely simple assembly operations and the like which can be readily performed by unskilled persons in a minimum of time and labor, and at the same time provide a finished installation which presents the desired uniform accurate disposition of the panel tiles achieved by expert installers.

This is accomplished in the present invention by means of a novel clip member which may be readily mounted on a cooperable mounting member, suitably supported from the building structure, or on any other available structure as for example an existing runner structure.

In one embodiment the clip member comprises a mounting structure and a runner supporting structure integrally connected therewith, which in a preferred embodiment is in the form of a reversedly bent portion, formed from sheet or strip stock, whereby the same is generally U-shaped in transverse cross-section, and having the runner supporting structure depending from one leg of the U-shaped structure, i.e. the lower leg. The runner supporting structure is in the form of a planar flange or wall which has a T-shaped notch therein, the vertical portion of the T extending to and opening on the lower edge of the member. The T-shaped notch is adapted to receive an edge bead carried by the upper edge of the web portion of the runner to be assembled therewith, in which the bead and adjacent portion of the runner web are T-shaped in transverse cross-section with the proportions of the notch being such that it is generally complemental to such T-shaped portion of the runner, whereby such portion of the runner may be extended through the notch in the clip portion, and the head of the T interlocked with the adjacent portion of the runner bead to enable the runner to be supported from the clip.

The legs of the U-shaped mounting structure converge from their connection, with the edge of the free leg of the mounting structure being upturned to facilitate springing of the clip upon the horizontal edge of a supporting member or supporting runner. Normally such runners or supporting members are provided with free edge portions which are bent or folded back upon themselves to form a lip along the free edge thereof. Thus, the mounting structure of the clip may be sprung over such lip on the supporting member to prevent undesired separation therebetween.

In another embodiment the mounting structure of the clip is formed with two spaced oppositely disposed U-shaped portions, each adapted to receive one of the tile supporting flanges of a runner with the runner-supporting structure being of double thickness and connected to each mounting portions, thus distributing the ceiling load to both flanges of a runner of an existing inverted T-bar ceiling.

In further embodiment the mounting structure may be constructed for use with C-shaped channel supporting members or so-called hat-shaped channel members.

BRIEF DESCRIPTION OF THE DRAWINGS

In the drawings wherein like reference characters indicate like or corresponding parts:

FIG. 1 is a perspective view of a portion of a panel supporting runner and the connection thereof, by means of a clip member in accordance with the present invention, to a supporting member;

FIG. 2 is a transverse sectional view through a mounted runner, illustrating its engagement with such clip member;

FIG. 3 is a perspective view of the clip member illustrated in FIGS. 1 and 2;

FIG. 4 is an elevational view, illustrating the mounting of the clip member to an existing, previously installed runner;

FIG. 5 is a sectional view taken approximately on the line V—V of FIG. 4;

DETAILED DESCRIPTION OF THE INVENTION

Figure 7:
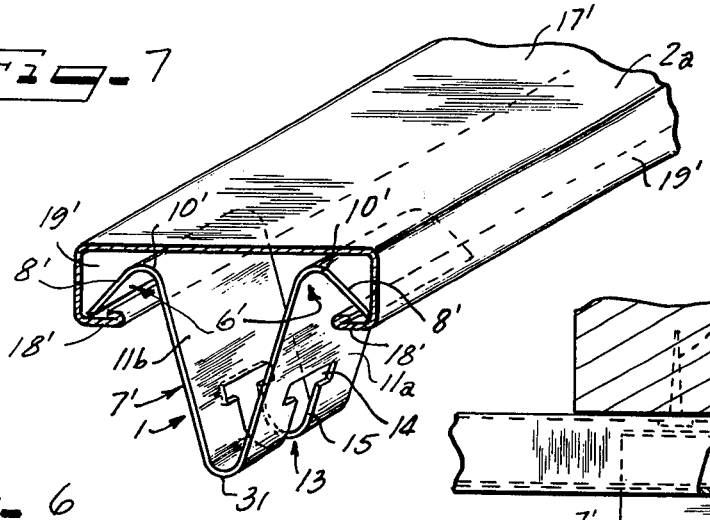
FIG. 7 is a perspective view of a further embodiment of the invention, for use with C-shaped channel supporting members.
Figure 6:
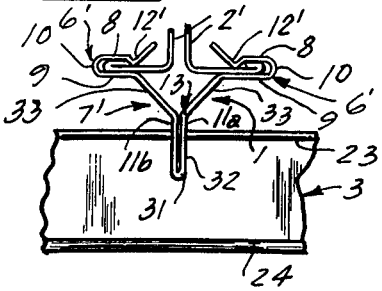
FIG. 6 is a sectional view, similar to FIG. 4, illustrating a further embodiment of the invention.

FIGS. 1 and 2 illustraate the application of a clip member 1, embodying the invention, to a supporting member 2, with the clip being adapted to receive and support a runner 3, with the supporting member 2 being adapted to be suitably connected, for example by nails 4 or the like to suitable support means, for example a building beam 5, forming a part of the supporting structure for the ceiling assembly.

As will be particularly apparent from a reference to FIG. 3, the clip 1 comprises a mounting structure, indicated generally by the numeral 6, and a runner-supporting structure, indicated generally by the numeral 7, integrally connected with the structure 6. The entire clip member may be readily manufactured from a single piece of strip stock suitably formed or bent to provide the respective structures 6 and 7. The mounting structure 6 is of generally U-shape in transverse cross-section, having a pair of legs or walls 8 and 9 which are connected at corresponding ends by an intermediate portion 10. The runner-supporting structure 7, in the embodiment illustrated, comprises a single generally planar member 11 which is integrally connected at its upper edge with the adjacent outer edge of the lower leg 8 of the mounting structure, the corresponding free edge of the opposite upper leg 9 of the mounting structure having an upturned free edge portion 12, with the legs 8 and 9 extending in converging directions from the intermediate wall 10.

The downwardly depending supporting flange or wall 11 is provided with a generally T-shaped notch therein, indicated generally by the reference numeral 13, with the notch comprising a transversely extending portion 14 forming the upper cross portion of the T and a downwardly extending vertically disposed portion 15. In the embodiment illustrated the downwardly depending free end portions 16 of the member 11 are provided with generally arcuate-shaped edges as will be apparent from a reference to FIGS. 2 and 3.

In the application of the clip 1 as illustrated in FIGS. 1 and 2, the supporting member 2 is illustrated as comprising a Z-runner having an upper horizontally extending wall 17 and a lower horizontally extending wall 18, which walls extend in opposite directions from a generally vertically extending intermediate wall 19, with the free edges of the walls 17 and 18 each having a reversely bent edge portion 20 and 21 which strengthen and provide a degree of rigidity to the free edges of the respective walls.

The runner 3 is illustrated as being of a one-piece construction, bent to form a web portion 22 of double thickness terminating along its upper edge in a relatively flat bead 23 which, with the adjacent portion of the web 22, has a T-shaped configuration in transverse cross-section. The lower edges of each of the two walls forming the web portion 22 are provided with outwardly extending flanges 24 which are disposed in a common plane and are each provided with a respective inturned edge 25. As will be apparent from a reference to FIG. 2 the notch 13 in the member 11 of the clip is proportioned to be generally complementary to the T-shaped upper structure of the runner 3, with the vertically extending portion 15 of the notch being of a size to freely receive the web 22 of the runner but considerably less in width than the corresponding transverse dimension of the bead 23 whereby the bottom surfaces of the bead may seat upon and be interlocked with the adjacent lower edges 14' of the lateral extending portion 14 of the notch 13. Thus, the runner 3 may be readily engaged with the clip and supported thereby from the bead portion 23.

As illustrated in FIG. 2, the outwardly extending flanges 24 of the runner 3 may be employed to support ceiling panels or tiles 26, indicated in broken lines, which are provided with respective slots 27 in their edges of a size to receive the flanges 24 whereby they may be readily supported by the runner 3.

In assembling a ceiling structure such as illustrated in FIGS. 1 and 2, the mounting runners or members 2 are attached to available supporting members such as beams 5 with the members 2 disposed at suitable spaced intervals in generally parallel relation, and having a spacing such that adequate support will be provided to the tile supporting runners 3. Following mounting of the runners 2 the respective runners 3 are attached thereto, for example by initially sliding a sufficient number of clips 1 on each runner 3 to provide a clip for each mounting member 2 involved. The runner 3 is then disposed in approximate desired position and a clip 1 is engaged with each mounting member 2 by springing the U-shaped portion 10 of the clip over the horizontally extending wall 18 of the member 2. The runners 3 and tiles 26 may be assembled in suitable sequence in accordance with generally accepted techniques normally employed in concealed suspended ceiling structures of the type here involved, with suitable cross members likewise being employed as may be desired. Such cross runners may employ any suitable construction, for example in accordance with known techniques.

It will be particularly appreciated that the clip 1 provides complete freedom with respect to the disposition of the runner 3 with respect to the supporting member 2 as the clip 1 may be slid along the member 2 to any desired position and in like manner the runner 3 may be slid longitudinally through the clip to any desired location along the runner. Consequently, neither the member 2 or the runner 3 involve any preset fixed position with respect to one another. It will be apparent that in mounting the clip 1 to the supporting member 2 the upturn edge or lip 12 of the leg 9 provides a camming action, readily enabling the springing of the legs 8 and 9 sufficiently to permit reception of the edge 21 of the member 2 into the U-shaped mounting structure.

FIGS. 4 and 5 illustrate the application of the invention to an existing ceiling structure which is to be used as the supporting structure for a new ceiling in accordance with the invention. As illustrated, the supporting member 2' is in the form of a suspended ceiling runner, for example a main runner which is suitably supported and in turn originally supported a plurality of tiles or panels 26' resting on the oppositely disposed flanges 18' of the runner.

It will be appreciated that the clip 1 can be readily sprung on one of the flanges 18' of the runner 2' in the same manner as illustrated in FIGS. 1 and 2 and at the same time, if desired, it is not even necessary to remove any of the panels 26' of the old ceiling structure as the leg 9 of the U-shaped mounting structure 10 may be readily inserted between a panel 26' and the adjacent flange 18', as illustrated in FIG. 4. As the installation otherwise would be identical with that described in connection with FIGS. 1 and 2, no need is seen to repeat the same.

Any of the arrangements illustrated in FIGS. 1–5 may be terminated adjacent a wall or partition member (not illustrated) by means of an angle member 28 having a vertical leg 29 which is adapted to be suitably secured to such a wall or partition and a horizontally extending leg 30 which is adapted to underlie the adjacent edge portions of a tile 26 thus finishing the peripheral edges of the ceiling.

FIGS. 7 and 8, and FIGS. 9 and 10, disclose two further embodiments of the invention illustrating the application thereof to supporting structures of different constructions.

FIG. 7 illustrates a clip adapted for use with a C-shaped channel member having spaced parallel downwardly depending side walls 19' integrally connected by an intermediate top wall 17', and provided at the free edges of the walls 19' with inwardly oppositely directed flanges 18', the free edges of which are folded over upon themselves similar to the edge portions 25 of the flanges 24 of the runner 3.

In this construction the clip 1 employs two mounting portions 6' respectively integrally connected to corresponding walls 11*a* and 11*b* which in turn are integrally connected at the bottom edge 31, with the walls 11*a* and 11*b* diverging from such common connection. The mounting portions 6' each comprise a leg or wall 8', the free edge of which is adapted to bear on a corresponding flange 18' of the member 2*a,* with the legs 8' and associated walls 11*a* or 11*b* extending in diverging directions from the connecting portion 10' thus giving the clip a more or less M-shaped cross-section, with the outer legs 8, 9 being shorter than the inner legs 11*a,* 11*b* of the M-configuration. As clearly illustrated in FIGS. 7 and 8, each of the walls 11*a* and 11*b* is provided with a T-shaped notch 13, which notches merge at the connecting portion 31, thereby forming a continuous slot across the clip structure, capable of receiving the upper end of the tile or panel supporting runner 3, as clearly illustrated in FIG. 8.

In the support of a runner by means of this clip structure, it will probably be expedient, in most cases, to insert the desired number of clips upon the runner to be installed and then engage such runner with successive C-members 2*a* by springing the walls 11*a* and 11*b* of a corresponding clip toward one another a sufficient distance to permit insertion of one of the leg portions 8' in suitable position and then passing the other leg portion inwardly beyond the other flange 18', whereby, upon release of the clip member, it will assume the position illustrated in FIG. 7. Obviously, in some cases it may be desirable or practical to initially engage the clip member with the supporting member 2*a* and then thread the runner 3 through the slots in the respective clip slots.

Figure 9:
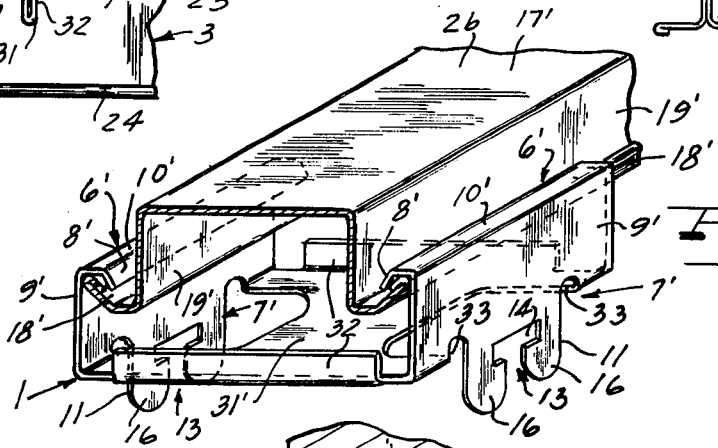
FIG. 9 is a perspective view of another embodiment of the invention, for use with a so-called hat-shaped channel member.
Figure 10:
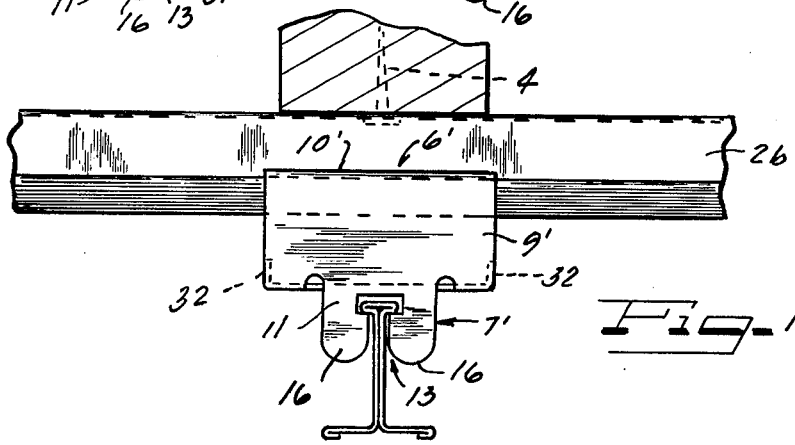
FIG. 10 is a side elevation of the structure of FIG. 9, with a runner engaged therewith.

FIG. 9 illustrates a further embodiment of the invention, particularly adapted for use with so-called hat-shaped channel members such as the channel 2*b,* of common construction, and comprising a pair of spaced parallel downwardly depending side walls 19' connected by an intermediate top wall 17', and thus generally similar to the C-beam of FIG. 7. However, the flange portions 18' are directed outwardly from the side walls 19', those illustrated initially extending from their respective side walls, in a generally horizontal direction for a short distance and then inclined upwardly, with the free edge portions folded back upon themselves. The clip in this construction is of generally channel-shape having a bottom wall 31' which connects respective spaced parallel upwardly directed leg portions 9' which are connected at their upper free edges with respective leg portions 8' by an intermediate wall 10'. The leg portions 8', 9' together with the intermediate portions 10' form a generally U-shaped structure, with the proportions of the various elements being such that the leg portions 8' can be disposed adjacent the upper faces of the outer portion of the flanges 18' with the intermediate portions 10' seated on the edge of the flanges 18'. Struck out from the wall 31' connecting the legs 9' are respective runner supporting portions 7' which directly correspond to the mounting structure 7 of the construction illustrated in FIGS. 1–5. As illustrated, the legs 9' are provided with respective punched out areas 33 whereby the bend between the legs 9' and the intermediate wall 31' does not directly intersect the wall 11 of the runner supporting portions 7', and thus does not interfere with the retention of the mounting structure 7' with plane of the leg 9'.

Figure 8:
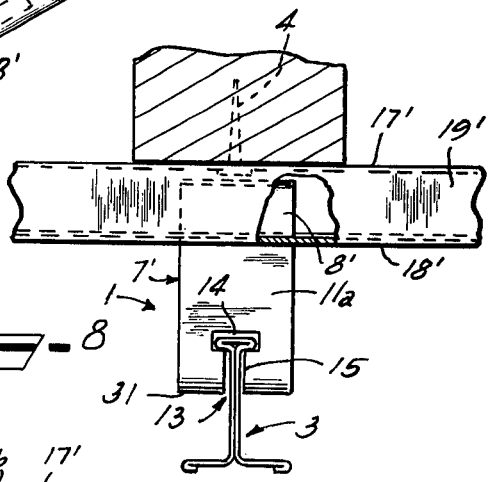
FIG. 8 is a side elevation of the structure of FIG. 7, with a runner engaged therewith.

In use, the clip of FIGS. 8 and 9 may be assembled with the runner 3 and supporting member 2*b* in substantially the same manner as previously described with respect to the construction of FIGS. 7 and 8 with the clip, for example after engagement of the runner 3 therewith, being engaged with the member 2 by hooking one of the legs 8' over the adjacent flange 18' and then applying upward force to the opposite side of the clip to spring the opposite leg 8' over the adjacent flange 18' with the parts springing sufficiently to permit the interlocking of the clip with both flanges of the supporting member 2*b.*

It will be appreciated from the above disclosure that we have provided a novel clip structure which is exceedingly simple in construction and which will efficiently secure a runner for ceiling panels to a suitable supporting member, which may be of widely differing construction, for example, of inverted T-shape, C-shape or hat-shape in transverse cross-section, even being a runner from a previously installed ceiling. Further, the clip member requires no attaching screws or other separable elements, nor does it require any special tools to attach the same, while providing complete flexibility with respect to the disposition of the clip along its supporting member and along the runner to be supported thereby.

Having thus described our invention it will be obvious that although various minor modifications might be suggested by those versed in the art, it should be understood that we wish to embody within the scope of the patent granted hereon all such modifications as reasonably, and properly come within the scope of our contribution to the art.

We claim as our invention:

1. A clip member for use in suspended ceiling structures utilizing panel-supporting grid runners of inverted T-shape in transverse cross-section, having a flat central vertical web portion terminating at its lower edge in oppositely directed outwardly extending flanges disposed in a common plane, adapted to receive and support the edge portions of cooperable ceiling panels, with such web portions terminating at its upper edge in a longitudinally extending bead having a transverse width greater than the thickness of said web to form a generally T-shaped upper edge portion, said clip member comprising a single piece of strip stock formed to provide an upper mounting structure and a lower runner-supporting structure integrally connected therewith, the runner-supporting structure comprising a pair of walls which are connected at their bottom edges, and extend upwardly therefrom in diverging directions with each wall having a notch therein of generally T-shaped configuration, aligned with one another, and each defining a relatively narrow leg portion having parallel edges spaced apart a distance slightly greater than the thickness of such a runner web, and opening in common at their connecting bottom edges, each notch, at the top thereof, having a relatively larger portion, communicating with said narrow leg portion, of a size to receive the bead of such a runner with such larger portion having a configuration generally complemental to the cross-sectional configuration of such a bead, said larger portion having bottom edge portions extending laterally outward from the respective vertical edges of said narrow portion, disposed to engage adjacent cooperable portions of such a bead for supporting the latter and thereby such a runner therefrom, with the latter adapted to be interlocked with the clip by insertion of the bead of such runner in said larger portion and said web in said narrow portion, and relative sliding movement between the clip and runner, said mounting structure comprising two mounting portions, each extending downwardly and outwardly from the upper free edge of a corresponding wall of said pair to form a clip of generally M-shape in transverse cross section, with each of said mounting portions adapted to engage respective cooperable upwardly facing means of a support member of inverted C-shaped configuration.

2. A clip member for use in suspended ceiling structures utilizing panel-supporting grid runners of inverted T-shape in transverse cross-section, having a flat central vertical web portion terminating at its lower edge in oppositely directed outwardly extending flanges disposed in a common plane, adapted to receive and support the edge portions of cooperable ceiling panels, with such web portions terminating at its upper edge in a longitudinally extending bead having a transverse width greater than the thickness of said web to form a generally T-shaped upper edge portion, said clip member comprising a single piece of strip stock formed to provide an upper mounting structure and a lower runner-supporting structure integrally connected therewith, the runner-supporting structure having notch means therein of generally T-shaped configuration, defining a relatively narrow leg portion having parallel edges spaced apart a distance slightly greater than the thickness of such a runner web, opening on the bottom edge portion of the clip, said notch means, at the top thereof, having a relatively larger portion, communicating with said narrow leg portion, of a size to receive the bead of such a runner with such larger portion having a configuration generally complemental to the cross-sectional configuration of such a bead, said larger portion having bottom edge portions extending laterally outward from the respective vertical edges of said narrow portion, disposed to engage adjacent cooperable portions of such a bead for supporting the latter and thereby such a runner therefrom, with the latter adapted to be interlocked with the clip by insertion of the bead of such runner in said larger portion and said web in said narrow portion, and relative sliding movement between the clip and runner, said mounting structure comprising a pair of mounting parts each generally inverted U-shape in transverse cross-section which are connected by an intermediate laterally extending connecting portion with the inner legs of the respective mounting portions adapted to engage the longitudinally extending free edge portions of a so-called hat-shaped channel member, for support therefrom, said runner-supporting structure extending downwardly from said mounting structure, said runner-supporting structure comprising a downwardly depending wall being formed from the stock of said laterally extending intermediate connection portion.

3. A clip according to claim 2, wherein said wall of the runner-supporting structure is disposed in the plane of the outer leg of one of said mounting portions.

4. A clip according to claim 2, wherein said runner-supporting structure comprises a pair of downwardly depending walls, each disposed in the plane of a respective outer leg of said mounting portions, said T-shaped notch means comprising a T-shaped notch in each of said downwardly depending walls, said notches being laterally aligned with the vertical portions thereof opening on the respective lower edges of the associated wall, for cooperable reception and support of the T-shaped edge portion of a runner to be suspended thereby.

* * * * *